United States Patent [19]

Severinsson

[11] 4,314,399

[45] Feb. 9, 1982

[54] METHOD OF PRODUCING MOULDS

[76] Inventor: Lars M. Severinsson, Östra Hyllievägen 99, 216 22 Malmö, Sweden

[21] Appl. No.: 761,729

[22] Filed: Jan. 24, 1977

[30] Foreign Application Priority Data

Jan. 28, 1976 [SE] Sweden ..... 7600895

[51] Int. Cl.[3] ..... B22F 3/24

[52] U.S. Cl. ..... 29/420; 75/229; 75/DIG. 1; 428/545; 428/368

[58] Field of Search ..... 75/229; 428/902, 367, 428/368, 545; 29/420, 420.5

[56] References Cited

U.S. PATENT DOCUMENTS

| | | | |
|---|---|---|---|
| 2,363,337 | 11/1944 | Kelly | 29/420 |
| 2,922,721 | 1/1960 | Tarkan et al. | 428/545 |
| 3,053,713 | 9/1962 | Juras | 29/180 R |
| 3,101,514 | 8/1963 | Callender et al. | 29/420.5 UX |
| 3,360,347 | 12/1967 | Todd | 428/545 |
| 3,608,170 | 9/1971 | Larson et al. | 428/545 |
| 3,623,630 | 11/1971 | Rode | 428/545 |
| 3,706,550 | 12/1972 | Umehara et al. | 75/200 |
| 3,818,581 | 6/1974 | Vartanian et al. | 29/419 |

*Primary Examiner*—Francis S. Husar
*Assistant Examiner*—V. K. Rising
*Attorney, Agent, or Firm*—Bucknam and Archer

[57] ABSTRACT

This invention relates to a method of producing a mold for use as a part of a tool for shaping of moldable material and having relatively high strength and heat resistance characteristics. According to the invention there is formed a porous body of sinterable material in contact with a pattern to form a material shaping surface on the body; the body when still in contact with the pattern surface is sintered and the sintered body is at least partially filled with infiltrating material having a melting point lower than that of the sintered body. The infiltrating step is effected in such matter that the pores of the surface of the sintered body in contact with the pattern surface are filled by infiltrating material from the side of the body opposite to the pattern surface whereby also the infiltrating material which fills the pores of the sintered body in the surface thereof is formed by the pattern surface.

1 Claim, 6 Drawing Figures

5

METHOD OF PRODUCING MOULDS

This invention relates to molds for shaping moldable material, in particular plastic and sheet-metal, and methods of producing such molds.

U.S. patent application No. 642,376 which issued as U.S. Pat. No. 4,088,046 teaches a method of producing molds which consists of a mold shell of metal and a supporting or backing body bonded to the rear face of the mold shell. The mold shell is produced by deposition of metal onto a pattern surface of a pattern so that the mold shell acquires a shaping surface which conforms to the pattern surface of the pattern body. The deposition of the metal for producing the shell and forming the shaping surface thereon is effected by one of the processes which have become known under the names flame spraying, plasma spraying or ionization spraying of molten metal and which are carried out with a spray gun or like apparatus, or by metal vaporization in vacuum. The supporting body is then produced for instance from an epoxy resin which is bonded to the rear face of the metal shell. This operation is carried out with the metal shell still in position on the pattern body to prevent the relatively thin metal shell from being damaged or deformed by handling operations when the supporting body is bonded thereto. After the supporting body and the shell are bonded together, they are removed as a unit from the pattern body and used as a molding part of a forming tool for forming articles of thermoplastic materials.

One object of the present invention is to improve the mold producing technique and especially the production of molds comprising supporting bodies of sintered materials having shaping surfaces formed thereon.

Another object of the present invention is to permit an economical production of a mold of high strength material which comprises a porous skeleton body of sintered powder which has shaping surface formed thereon by the pattern surface of a pattern before the sintering process is completed and in which the porous skeleton body is strengthened by infiltrating material. During the sintering process the infiltrating material is infiltrated in the direction from the side of the body opposite to the shaping surface thereon and formed by said pattern surface.

According to the present invention, a porous body of sinterable powder and intended for use as a molding part of a forming tool is formed in contact with a pattern surface of a pattern of a material which is infusible at the sintering temperature for the powder to be sintered. By this forming process the surface of the body in contact with the pattern surface is formed. The porous body with the pattern of infusible material is placed in a sintering furnace and sintered in contact with the pattern, and during the sintering phase the porous body is infiltrated by an infiltrating material such that infiltrating material is caused to fill the pores of at least a substantial part of the porous body and to flow in the direction from the side of the body opposite to the surface thereof in contact with the pattern surface of the pattern to be formed and fill the pores in that surface of the body which has been formed by said pattern surface. The body with the pattern, after the sintering and infiltrating process is effected, is removed from the furnace and separated from the pattern to be used as a die or mold in a forming tool.

The forming tool, according to the present invention, has a shaping surface, which is formed as a true negative of a pattern surface. Further, this shaping surface and at least a layer adjacent this surface consists of a material, which has been infiltrated by another material, such as a metal, which is infiltrated in the direction from the interior of the body of the mold in the direction of the shaping surface, that is from the side of the porous body opposite to the pattern surface and penetrates into the pores of the surface of the porous body.

Thus, the method of producing a die or mold according to the invention consists of producing the body which is intended to be used as the die or mold by shaping a pulverulent or granular sinterable material based on iron into a pulverulent body or mass, forming in said mass a forming or shaping surface as a negative of a pattern surface, that is to say a surface having the shape and structure into which said forming or shaping surface of the body is to be shaped, sintering the pulverulent body and infiltrating it at least in its layer closest to the shaping surface of the body such that infiltrating material penetrates from the side of the body opposite to, and to be formed by, the pattern surface. The infiltrating material is preferably a metal or metal composition which is capable of melting at the sintering temperature of the porous body and solidifies when cooled. As a preferred modification the infiltrating material is in the form of a liquid capble of solidifying by heating at the sintering temperature used for sintering the body. In either case the infiltration is performed in such manner that the infiltrating material penetrates to the formed shaping surface on the body and is shaped by the pattern so that the pores of the shaping surface of the sintered body are filled out with clean infiltrant material and the infiltrating material, when solidified, will strengthen the body at least in the layer closest to the shaping surface of the body.

According to the present invention the body which is intended to be used as a die or mold is produced on a heat resistant pattern, and sintered and infiltrated while still in contact with and supported by the latter. When forming the body of a metal powder, the body is preferably pressed or compacted for instance by vibration or by ultra sound. The unit comprising the pattern and the body is then introduced into a furnace in which sintering of the body is performed. Sintering is preferably performed for a short time at a relatively low temperature so that an initial bond is obtained between the grains of the metal powder before infiltration is effected.

The porous body is preferably formed by a metal of the kind used for conventional industrial production of sintered details of metal. Preferably, however, the sintering of the body is interrupted when the material which forms the body is bonded by sintering into a continuous skeleton of grains before infiltration of the pores of the body is effected. The sintering temperature shall not be so high that the pattern is deformed and should for the sintering of iron-based metal powder not exceed about 1200° C.

The invention is further illustrated by the accompanying drawing.

Figure 1:
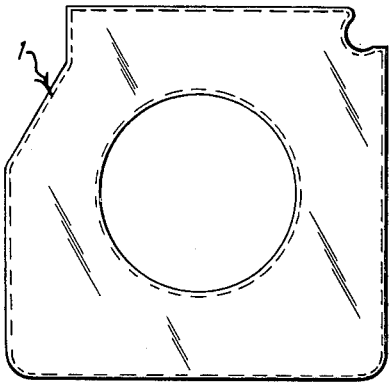
FIGS. 1 and 2 show the outer side and the inner side, respectively, of a mold to be manufactured by means of the method according to the invention.
Figure 2:
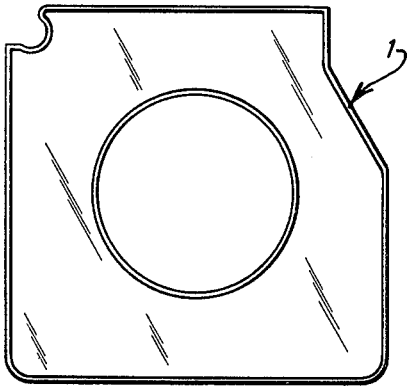

Numeral 1 in FIGS. 1 and 2 designates the pattern which is an original article or a cast made of refractory material, for example ceramics of an original article. The body 1 in FIGS. 1 and 2 must be refractory because during the subsequent manufacture of a forming tool it must accompany the mold into the sintering furnace.

Figure 3:
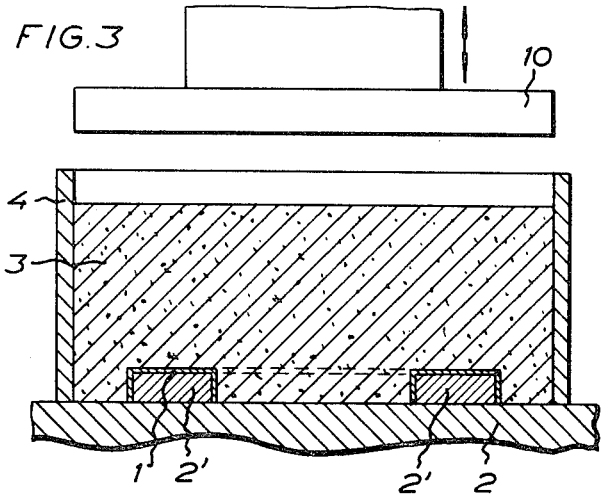
FIGS. 3 through 6 show the various stages of the mold manufacturing according to the method of the invention.

In FIG. 3 the article 1 in FIGS. 1 and 2 is placed on a base 2. Material 2', serving as supports, is disposed in the void spaces of the pattern 1. Like the base 2, this material 2' must be refractory and must withstand a sintering temperature of about 1100° C. Of course, the pattern 1 also must withstand the sintering temperature and besides the pattern 1 must not be appreciably deformed nor change its dimensions at the sintering temperature. A great many materials can be shaped after an original pattern and then be hardened, and after hardening withstand high temperatures without any substantial change of shape and dimensions. The pattern 1 in FIGS. 1 and 2 consists of such a material.

The body 3 in FIG. 3 consists of iron powder with an addition of a small amount of carbon powder and optionally other substances. The powder is compressed or vibrated in an outer cylindrical mold 4 by means of compression or vibration apparatus designated 10.

Figure 4:
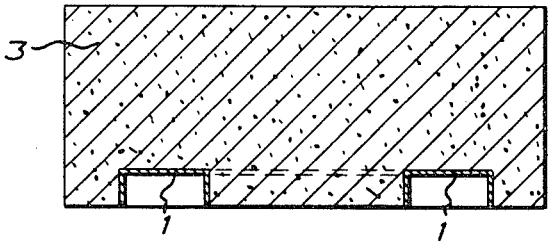

Afterwards the body 3 together with the pattern 1 is removed from the outer mold 4 which is employed for the shaping of the body. The shaped, but still unsintered body 3 and the pattern 1 are shown in FIG. 4.

Figure 5:
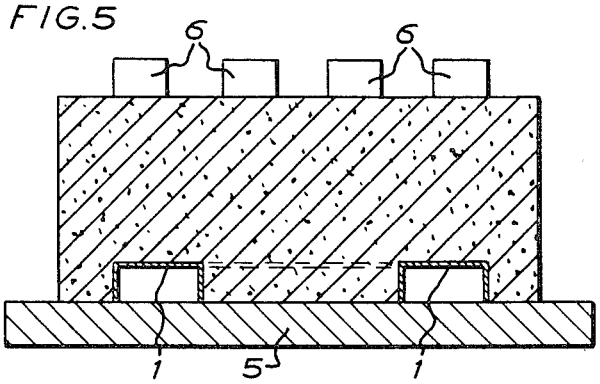

FIG. 5 shows the same body 3 together with the pattern 1 reposing on a base 5 after it has been sintered in a sintering furnace at a temperature of say 1060° C.

Sintering can be effected for the desired sintering time but it is preferred not to carry out the sintering as far as is theoretically possible, but only to such an extent that a porous steel skeleton of relatively great strength is obtained.

The body 3 in FIG. 5 is thus sintered in the manner described above.

Elements of infiltrating material 6 having a lower melting point than the sintering temperature, are placed on the body 3. The elements 6 may consist of copper, a copper alloy, beryllium copper or other suitable material which on melting is capable of wetting the metal in the metal powder body 3.

The temperature is raised in the furnace so that the metal elements 6 will melt and be drawn into the pores of the body 3.

The fact that the infiltration takes place in the direction towards the future mold surface, brings the following very essential advantages.

When the metal of the metal elements 6 melts and is drawn into the pores of the body 3, inevitably small amounts of oxides will form, and these together with impurities, if any, will form a certain amount of slag. Such slag formation weakens the strength of the structure and to a certain extent makes the material porous. It is particularly inconvenient if such slag formation occurs at the shaping surfaces, that is, the surface of the body 3 closest to the article 1.

Surprisingly enough, it has proved that the body 3 in itself constitutes a very effective filter which prevents impurities and slag formation accompanying the infiltrating material to the very shaping surfaces. The sintered body 3 thus forms a filter which prevents the impurities from reaching the shaping surfaces. The structure 8 closest to the shaping surfaces closest to the pattern 1 will therefore be very dense and pure, while the structure closest to the upper side of the body 3 may contain an amount of slag or other impurities, which does not, however, imply any real drawback.

The method described hereinabove permits the production of a forming tool which consists of a body 3 of steel infiltrated with copper. At the shaping surfaces the forming tool can have a Brinell hardness of about 300.

Figure 6:
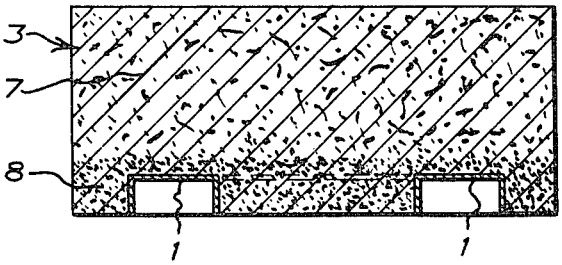

If, in lieu of pure copper, a suitable copper alloy is used, the body 3 shown in FIG. 6 can be hardened to a Brinell hardness of about 350, and by using beryllium copper it is possible to harden the body to a Brinell hardness of about 400.

Hardening of the infiltrated body can be effected if the thus sintered, porous skeleton body essentially consists of hardenable material, such as carbon steel, chromium steel etc.

According to the invention, the sintered, porous supporting skeleton body is sealed by infiltration of another metal having a lower melting point than the material of the body and a lower melting point than the sintering temperature used. Of course, a metal or metal composition compatible with and capable of "wetting" the porous body material should be chosen. If sintering of the porous body material tends to cause shrinking, this tendency can be compensated or inhibited by using a suitable infiltrating material which tends to balance the shrinking tendency of the skeleton body by filling the heatexpanded pores thereof and preventing contraction during cooling. The infiltration may be performed by placing metal on the body and melting said metal into the pores thereof. However, infiltration can also be performed in such a way that only the shaping surface and an adjacent layer of the body are infiltrated. The infiltrating direction is a direction from the side of the body opposite to the shaping surface.

The shaping surface of the body is preferably realized by forming the body from a sinterable mass, such as an iron or steel powder mass, directly on a pattern of heat resistant material. The use of a fine-grained metal powder mass results in a relatively dense structure which has very fine pores and which, after infiltration with a suitable metal, has the desired strength and a smooth shaping surface for using the body as a die or mold for forming articles of plastic and also of metal, for instance by compression forming technique. The sintering can be effected to a desired sintering stage, and the sintered body can be hardened. By using a fine-grained metal powder and by performing the sintering for a relatively short time and at a relatively low temperature the shrinking tendency can be reduced and a strong skeleton of bonded fine-grained metal particles pores can be obtained. The very fine pores of this structure can be filled with another metal for sealing of the skeleton according to the above description.

It has proved to be of particular advantage to use fine-grained metal powder which before use is subjected to a grain-deforming cold working operation whereby the grains are brought into state of stress. Such fine-grained metal powder can be made sufficiently compact by vibrations only, e.g. so-called ultra sound vibration, and in addition the sintering temperature can be lowered.

Heat treatment and hardening to high strength can be effected without deterioration of the structure of the shaping surface of the body, and dimensional stability or compensation can be attained by suitable choice of infiltrating material which is molten into the pores of the sintered body. The infiltrating material which penetrates the shaping surface of the body and comes into contact with the pattern is prevented from forming a bond therewith by treating the pattern surface of the pattern with any known suitable releasing agent, for instance a salt readily soluble in a liquid, such as common salt NaCl which is dissolved when release is desired by dipping pattern and the sintered mold into the water. The sintered mold can then usually be readily separated from the pattern. Preferably, the pattern is made of a suitable infusible material which is selected with regard to machinability or moldability, surface finish, heat resistance, and has a high dimensional stability at prevailing temperatures.

According to one embodiment of the invention, a shell of metal infusible at the sintering temperature of the metal powder body can be deposited on a pattern and incorporated with the surface of the body which is to be formed by the pattern. This can be effected by deposition of a thin layer of metal on the pattern surface by known technique. The metal, such as nickel, which is deposited to form a thin metal shell on the pattern, shall be of such a nature that it will be bonded to the infiltrated surface of the porous metal powder body thereafter formed on said shell on said pattern. Of course, the metal from which the shell is to be formed shall withstand the temperature which is used for sintering said body. In this case the porous body of metal powder is formed on the preformed metal shell on the infusible pattern, whereupon the body, the shell and the pattern are placed in a sintering furnace. The temperature is raised to the sintering temperature of the metal powder and the infiltration of the porous body is effected such that the porous body is bonded to the metal shell. The body, the metal shell bonded thereto and the pattern are removed as a unit from the furnace, whereupon the pattern is separated from the shell which is bonded to the infiltrated body and forms the shaping surface thereon.

The body can also be produced from ceramic material. The shaping surface can be formd also in this case directly on the shapable sinterable powder mass by applying said mass directly onto a pattern treated with a suitable releasing agent.

It will be realized from the above that the invention provides ample opportunities of varying not only the die or mold production technique taught by the above-mentioned patent application but also other known die or mold production techniques, such as the sintering and infiltration technique described in U.S. Pat. No. 3,706,550 where infiltration into a body of metal powder is effected from the interior thereof. A serious drawback of this known technique is that it is necessary to form a pattern of the same metal as the infiltration material by an expensive machining operation and that the whole pattern is infiltrated in the body and leaves the forming surfaces thereof without support during a substantial part of the infiltration step and the consolidation period when the temperature is lowered. A further drawback is that the infiltrating material during the infiltration is filtered by the powder body and leaves most of its impurities in the pores of the body nearest the shaping surface thereon. A major part of these impurities is slag which inevitably forms on fusion of the metal of which the pattern is made.

Copper and beryllium copper have proved to yield very satisfactory results as infiltrating material in sintered supporting bodies of metal powder. There are many beryllium bronzes which have considerably lower melting points than the temperatures used in sintering common iron and steel powder mixtures and these beryllium bronzes can therefore be infiltrated at temperatures considerably below the upper limit of the range of the preferred sintering temperatures.

Metal powder for the production of a sintered supporting body (where appropriate, a supporting body having a shaping surface) according to the invention can be mixed with suitable binding or cohesive agents to a moldable mass according to well-known technique for the production of sintered articles, and as already mentioned the mass can be applied to a previously produced mold shell of metal or directly onto the pattern; in both cases a compression can be brought about by pressure or for instance by ultra sound vibration.

A metal powder mass can be "loosely" sintered onto a model and then a metal, such as copper, beryllium copper, tin, zinc, aluminium etc. or mixtures thereof can be incorporated with the loosely sintered body. However, non-metallic materials are also conceivable, for instance enamel or ceramic material. The metallic or non-metallic material can be infiltrated by melting or otherwise, such that the material directly, or at a subsequent heat treatment, reaches the shaping surface and seals the future shaping surface of the sintered body. The shaped body is then separated from the pattern.

The invention provides a wide range of variations.

Coarse or fine-grained metal powder imparts to the sintered material greater or smaller hollows (pores). If a very fine-grained metal powder is chosen, the total pore volume of the sintered body will be relatively small, and it is then possible without any great economical disadvantages to use, as an alternative of copper and relatively cheap copper alloys, an expensive metal as beryllium copper which imparts to the sintered body satisfactory strength and can be infiltrated and hardened at a relatively low temperature.

Alternatively, a loosely sintered body, a supporting body alone or a supporting body with shaping surface or mold shell of metal, can be sealed and reinforced with enamel or ceramic material by immersion (under vacuum) in a slurry or slip and by subsequent heat treatment or heating of the material thus incorporated therewith.

A further alternative is to apply to a heat resistant mold, pattern, a mass of enamel on which a supporting body is then formed from sinterable material, for instance iron or steel powder, whereupon heating of the enamel and sintering of the metal powder is effected simultaneously. This will cause the supporting body to be infiltrated with enamel from the vicinity of the enamel layer so that the enamel constitutes a mold shell which is fixedly connected to the supporting body and very closely reproduces the surface of the pattern. The pores in the supporting body can then be sealed with metal in the manner described above for dimensional stabilization without causing the enamel layer to burst.

It has been mentioned that several different substances can be used to fill out the small pores of the sintered skeleton body, it being possible to use such substances as have a low heat expansion coefficient, whereby the dimensional contraction of the sintered body, when the temperature thereof is lowered from the sintering temperature or a lower temperature, can be prevented from progressing so far as it would normally do if the body consisted only of the sintered material. For this purpose, copper and beryllium bronze, respectively, has been mentioned as a particularly suitable metal and metal alloy. This metal or metal alloy is extraordinarily well suited since a preferred metal powder mixture consists of iron powder with a small addition of carbon, graphite, and copper. Sintering can be effected at about 1120° C. or lower and yields a sintered body of very high strength. The copper additive, however, has a tendency to increase the grain growth, and to eliminate this problem the powder mixture should also contain nickel.

A preferred composition for producing the sintered body according to the invention consists of sponge iron powder of small particle size and about 5% by weight of copper, about 5% by weight of nickel and about 0.35–0.65% by weight of graphite.

Experiments have shown that the tensile strength increases with increasing copper content and nickel content at any carbon level and that copper has the greatest influence. However, by the addition of copper alone the grain growth increases on sintering, and it is therefore advantageous to combine copper with nickel, whereby zero growth is attainable. The greatest strength at zero growth has been obtained at the following percentages: 4.0% nickel, 2.5% copper and 0.6% graphite. The reinforcing effect of nickel with this carbon content is limited but can be increased by addition of a smll amount of molybdenum to counteract the austenite retention effect. With a partially pre-alloyed iron powder having a carbon content of 0.6%, 4.0% nickel, 1.5% copper and 0.5% molybdenum and at a sintering temperature of 1120° C., there was obtained a tensile strength of 750 $N/mm^2$, which is a very satisfactory value.

The invention makes it possible to produce in a simple manner molds with heat resistant strong supporting bodies and with mold surfaces reproducing with great exactitude the contours of the patterns used. The invention makes it also possible to produce molds which are sufficiently heat resistant to the temperatures that may occur in various plastic shaping operations and are sufficiently strong to resist the prevailing pressures, for instance for sheet metal pressing and pressure molding of plastic. The molds produced in accordance with the invention are in respect of their properties almost comparable with the metal molds produced by conventional machining operations, although the cost of production is only a fraction of the cost of the conventionally produced metal molds.

What I claim and desire to secure by Letters Patent is:

1. A method of producing a mold comprising a body of a material having a relatively high strength and heat resistance and a material-shaping surface, which consists of:

(1) depositing a body of sinterable material of metal powder onto the surface of a pattern, the pattern being of a material capable of resisting a predetermined temperature and having a pattern surface which forms a negative picture of said material-shaping surface;

(2) forming said material-shaping surface on said body of said sinterable material as a positive picture of said pattern surface, said sinterable material being sinterable at a sintering temperature which is lower than said predetermined temperature and which is capable before it is sintered to be brought into a relatively easily shapable form and which after it is sintered forms a porous sintered body;

(3) sintering said formed body when still in contact with said pattern surface;

(4) introducing an infiltrating material of a metal into the side of the porous body opposite to said pattern surface, said infiltrating material which has a melting point lower than said sintering temperature melting and flowing into the pores of said porous body whereby said infiltrating material penetrates into the pores of said surface of the porous body formed in contact with said pattern surface, reaches said pattern surface and is shaped by the pattern surface and wherein said infiltrating material contains a slag and the slag is filtered by the body of the sinterable material and clean infiltrant free of slag reaches the pattern surface;

(5) cooling said sintered body which contains the infiltrated material and (6) separating said body from the pattern surface.

* * * * *